US010150027B2

(12) United States Patent
Fisher et al.

(10) Patent No.: US 10,150,027 B2
(45) Date of Patent: Dec. 11, 2018

(54) SHIN GUARD SLEEVE

(75) Inventors: Sam Fisher, Portland, OR (US); Carl Behrend, Portland, OR (US); Oliver McLachlan, Portland, OR (US)

(73) Assignee: Nike, Inc., Beaverton, OR (US)

( * ) Notice: Subject to any disclaimer, the term of this patent is extended or adjusted under 35 U.S.C. 154(b) by 1241 days.

(21) Appl. No.: 12/910,187

(22) Filed: Oct. 22, 2010

(65) Prior Publication Data

US 2012/0096616 A1 Apr. 26, 2012

(51) Int. Cl.

*A63B 71/00* (2006.01)
*A63B 71/12* (2006.01)
*A41D 13/05* (2006.01)

(52) U.S. Cl.

CPC ..... *A63B 71/1225* (2013.01); *A41D 13/0543* (2013.01); *A63B 2071/1258* (2013.01); *A63B 2243/0025* (2013.01)

(58) Field of Classification Search

CPC ..... A41D 13/088; A41D 13/0543; A63B 71/1225; A63B 71/1228; A63B 2243/0025

USPC ..... 2/22–24, 59, 62, 16, 455, 456; 128/878, 128/882; 602/26, 62, 63, 65, 13, 16, 23, 602/61; 20/22–24, 59, 62, 16, 455, 456

See application file for complete search history.

(56) References Cited

U.S. PATENT DOCUMENTS

| | | | | |
|---|---|---|---|---|
| 3,664,336 | A * | 5/1972 | Gelston | 602/70 |
| 4,084,586 | A | 4/1978 | Hettick | |
| 4,306,315 | A | 12/1981 | Castiglia | |
| 4,492,227 | A * | 1/1985 | Senn et al. | 602/63 |
| 5,318,507 | A * | 6/1994 | Greengarg | 602/19 |
| 5,987,778 | A | 11/1999 | Stoner | |
| 6,125,665 | A | 10/2000 | Lonati et al. | |
| 6,192,519 | B1 * | 2/2001 | Coalter | 2/16 |
| 7,032,246 | B1 | 4/2006 | LeMire | |
| 2003/0230121 | A1 * | 12/2003 | Yokoyama | 66/178 A |
| 2006/0179538 | A1 | 8/2006 | Dodd | |
| 2006/0260024 | A1 | 11/2006 | Lee | |
| 2009/0077704 | A1 * | 3/2009 | Duncan et al. | 2/16 |
| 2009/0077707 | A1 * | 3/2009 | Scheffer | 2/22 |
| 2009/0235422 | A1 * | 9/2009 | Lueking | 2/22 |
| 2009/0288451 | A1 * | 11/2009 | Yokoyama | 66/185 |

FOREIGN PATENT DOCUMENTS

| | | | |
|---|---|---|---|
| WO | 2003063622 | A2 | 8/2003 |
| WO | 2007066153 | A1 | 6/2007 |

OTHER PUBLICATIONS

Notification of Transmittal of the International Search Report and the Written Opinion of the International Searching Authority, or the Declaration, in International Application No. PCT/US11/57328, dated Mar. 9, 2012, 13 pages.

Chinese Office Action dated Jan. 23, 2015 in Chinese Application No. 201180050834.8, 9 pages.

* cited by examiner

*Primary Examiner* — Khaled Annis

(74) *Attorney, Agent, or Firm* — Shook, Hardy & Bacon L.L.P.

(57) ABSTRACT

Aspects of the present invention relate to a shin guard sleeve that extends higher in a calf portion than in a shin portion of the shin guard sleeve. Additional aspects may include a shin guard sleeve having an apex located in the calf region of a wearer to provide a volume able to be filled by the calf region of the wearer. Further, aspects may include one or more maintainers affixed to the shin guard sleeve to further resist slipping of the shin guard sleeve.

10 Claims, 5 Drawing Sheets

SHIN GUARD SLEEVE

BACKGROUND

Traditionally, a shin guard is used by an athlete to protect the shin region of the athlete from an impact. Shin guards, in an as-worn position, generally extend from below the knee to a location superior of the ankle. Shin guards may be an independent pad or a pad with a securing component. For example, a shin guard pad may be secured to a wearer using a strap, tape, a sock, or a sleeve. However, an athlete may desire for a way to secure a shin guard pad to his or her leg that is easy to position while still maintaining the shin guard pad in the desired location. Previous attempts to secure the shin guard pad may have been cumbersome or ineffective at maintaining the shin guard pad in a desired location.

SUMMARY

Aspects of the present invention relate to a shin guard sleeve that may extend higher in a calf portion than in a shin portion of the shin guard sleeve. Additional aspects may include an apex located in the calf region of a wearer to provide a volume able to be filled by the calf of the wearer. Further, aspects may include maintainers affixed to the shin guard sleeve to further resist slipping of the shin guard sleeve.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 2:
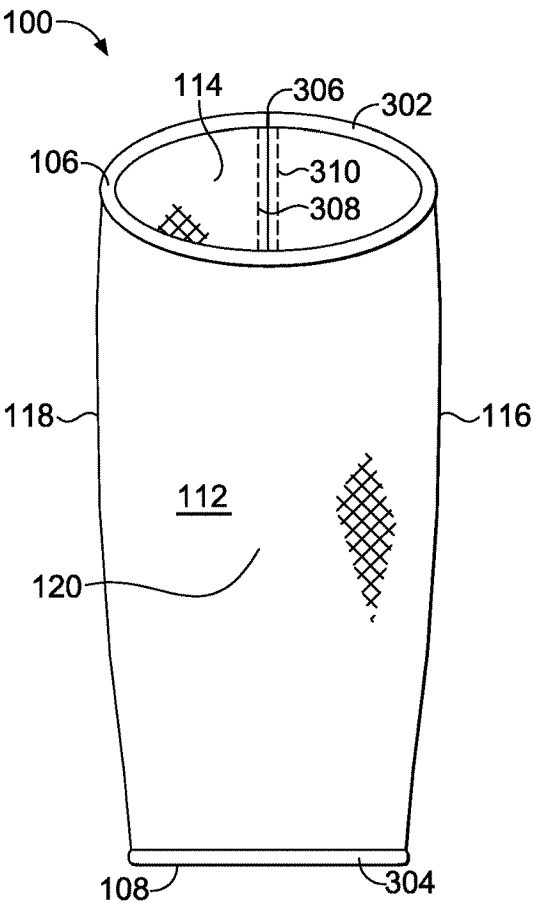
FIG. 2 depicts an anterior view of a shin guard sleeve, in accordance with embodiments of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Aspects of the present invention relate to a shin guard sleeve that may extend higher in a calf portion than in a shin portion of the shin guard sleeve. Additional aspects may include an apex located in the calf region of a wearer to provide a volume able to be filled by the calf of the wearer. Further, aspects may include maintainers affixed to the shin guard sleeve to further resist slipping of the shin guard sleeve.

Accordingly, in one aspect, the present invention provides a shin guard sleeve constructed from a flexible material. The sleeve has a top edge and an opposite bottom edge; an outer surface and an opposite inner surface; and an anterior portion and a posterior portion. When in an as-worn position on a wearer, the anterior portion is proximate a shin region and the posterior portion is proximate a calf region of the wearer. Additionally, an anterior portion length of the sleeve as measured from the bottom edge to the top edge near the anterior portion is less than a posterior portion length of the sleeve as measured from the bottom edge to the top edge near the posterior portion.

In another aspect, the present invention provides a shin guard sleeve constructed from a flexible material having a shin portion, an opposite calf portion, a bottom edge, and an opposite top edge. The shin portion of the shin guard sleeve is near a shin region of a wearer in an as-worn position. Additionally, the calf portion of the sleeve is near a calf region of the wearer in the as-worn position. Further, in an un-stretched state, the calf portion of the shin guard sleeve extends to an apex between the top edge and the bottom edge. The apex provides a volume of space able to be filled by the calf region of the wearer when in the as-worn position. Further yet, when in an un-stretched state, a calf height of the shin guard sleeve as measured from the top edge to the bottom edge near the calf portion is greater than a shin height of the shin guard sleeve as measured from the top edge to the bottom edge near the shin region.

A third aspect of the present invention provides a shin guard sleeve that has a shin portion and an opposite calf portion. The shin portion is near a shin region of a wearer's leg and the calf portion is near a calf region of the leg when the shin guard sleeve is in an as-worn position. The sleeve also has a medial portion and an opposite lateral portion. When in an as-worn position, the medial portion is disposed between the calf portion and the shin portion and the lateral portion is disposed between the calf portion and the shin portion. The shin guard sleeve also has a top edge and an opposite bottom edge. The medial portion, the shin portion, the lateral portion, and the calf portion of the shin guard sleeve are disposed between the top edge and the bottom edge. The shin guard sleeve also has a medial edge and an opposite lateral edge. When in an as-worn position, the medial edge and the opposite lateral edge join to form a joining seam extending from the top edge to the bottom edge proximate the calf region. The shin guard sleeve also has an intermediate portion between the top edge and the bottom edge that extends from the medial edge to the lateral edge near a medial apex and a lateral apex. Further yet, the shin guard sleeve has a shin distance as measured from the top edge to the bottom edge near the shin portion that is less than a calf distance as measured from the top edge to the bottom edge near the calf portion. Additionally, the shin guard sleeve has a bottom edge length between the medial edge and the lateral edge near the bottom edge that is less than an intermediate length of the shin guard sleeve between the medial edge and the lateral edge within the intermediate portion. The bottom edge length and the intermediate length extend across the shin portion as opposed to being measure across a potential joining seam. The shin guard sleeve may also include a maintainer coupled near the top edge.

Having briefly described an overview of embodiments of the present invention, a more detailed description follows The construction of a shin guard sleeve 100 of the present invention has the basic construction of a soccer-type shin guard sleeve for maintaining a shin guard pad along a shin region of an athlete. However, the shin guard sleeve 100 is comprised of a contoured profile that allows the shin guard sleeve 100 to form to and be supported by a calf region of the athlete. Aspects may include an apex (curved portion) located along a calf region that accommodates a curved calf muscle of the athlete. Additionally, aspects may include a calf hanger portion of the shin guard sleeve 100. The calf hanger portion may also contour to the calf muscle along an upper portion of the calf muscle such that the shin guard sleeve may rest on and be inhibited from sliding past the upper portion of the calf muscle, which may be smaller in circumference than the calf muscle proximate the apex region.

In aspects of the present invention, the shin guard sleeve 100 is a soccer-style shin guard sleeve. However, it should be understood that the novel concept of the invention could be employed on other types of shin guard sleeves.

The shin guard sleeve 100 may be formed from a flexible material, such as a textile, fabric, polymer, and the like. For example, a nylon material may be used to form the shin guard sleeve 100. The ability of the fabric to stretch may be limited in a direction and/or amount. For example, a material may be selected that provides limited stretch in a particular direction while resisting stretching in another direction. Continuing with this example, aspects of the invention may utilize a material that facilitates stretching in a lateral direction allowing a circumference of the shin guard sleeve 100 to accommodate flexing of a calf muscle. However, in this example, the material may be selected such that a vertical stretch is limited to allow the shin guard sleeve 100 to maintain an associated shin guard pad in an appropriate vertical location proximate a wearer's shin region. Stated differently, it is contemplated that a material having a unilateral direction of stretch (i.e., ability to stretch greater in one direction than in an orthogonal direction) is utilized to form one or more portions of the shin guard sleeve.

Additionally, it is contemplated that a material is selected that allows for a desired amount of ventilation to occur. For example, the shin guard sleeve 100 may, in an as-worn position, fit snuggly to a leg of wearer that is participating in a strenuous activity, such as soccer. As a result of the strenuous activity, a relative humidity of air trapped between the wearer's skin and the shin guard sleeve may elevate as the wearer's body attempts to dissipate heat through a sweating process. To effectively cool the wearer, it is desirable to allow the air near the skin that has an elevated relative humidity to dissipate and be replaced. Selecting a material that facilitates the movement of air may aid in cooling the wearer. Consequently, aspects of the present invention may utilize materials having a higher porosity, such as a mesh-type structure. Additionally, it is contemplated that one or more apertures are included in the shin guard sleeve 100 to provide specific location of increased air movement.

Figure 1:
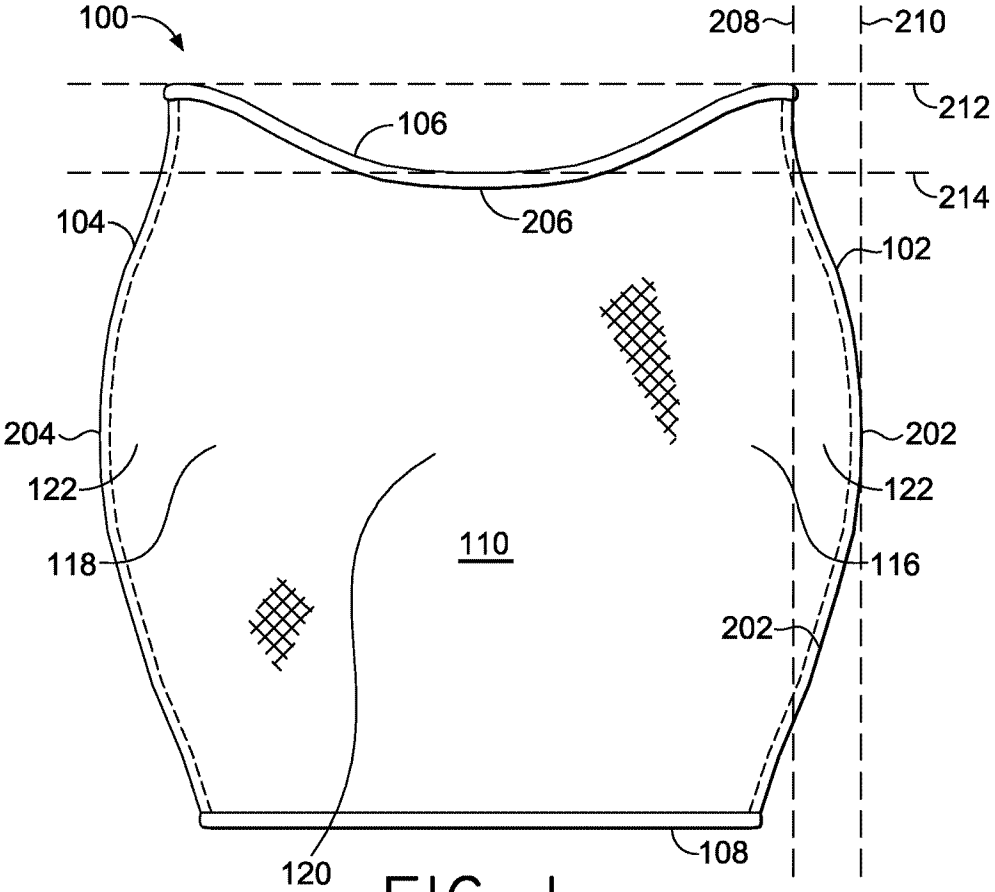
FIG. 1 depicts a shin guard sleeve residing in a plane, in accordance with embodiments of the present invention.

The shin guard sleeve 100 may be constructed from a fabric that, when not in an as-worn position, may lay in a common plane (e.g., lay flat), as depicted in FIG. 1. However, it is understood that the shin guard sleeve 100, when not in an as-worn position, may also have a cylinder-type (as seen in FIG. 2) formation, as will be discussed hereinafter. The shin guard sleeve 100 may include a medial edge 102 and an opposite lateral edge 104, as seen in FIG. 1. The shin guard sleeve 100 may also include a top edge 106 and an opposite bottom edge 108. Further, the shin guard sleeve 100 may have an inner surface 110 and an opposite outer surface 112. For example, when in an as-worn position, the inner surface 110 may be proximate a wearer's leg and in particular, the skin of the wearer. Conversely, the outer surface 112, when in as as-worn position, may serve as an exposed surface to the elements, which may allow the outer surface 112 to be used as a surface on which graphics and other markings may be placed for viewing by other individuals (e.g., a spectator).

The shin guard sleeve 100 may include a number of portions that extend between the top edge 106 and the bottom edge 108. In an exemplary aspect of the present invention, the following portions may be arranged in the following order, but it is understood that additional portions may be defined and the orientation/order of these portions may be altered. Moving in a direction from the lateral edge 104 toward the medial edge 102 (e.g., left to right with respect to FIG. 1) the shin guard sleeve 100 may include a section of a calf portion 122, a lateral portion 118, a shin portion 120, a medial portion 116, and another section of the calf portion 122.

When in an as-worn position, the calf portion 122 is located proximate a calf region of the wearer along a posterior region of the wearer's leg. Also, when in an as-worn position, the shin portion 120 is located proximate a shin region of the wearer along an anterior region of the wearer's leg. Stated differently, the shin guard sleeve 100 may include an anterior portion that is proximate a shin of a wearer and the shin guard sleeve 100 may also include a posterior portion that is proximate a shin region of the wearer, when in an as-worn position.

The medial portion 116, when in an as-worn position, is proximate a medial region of the wearer's leg, between the shin region and the calf region. Similarly, the lateral portion 118, when in an as-worn position, is proximate a lateral region of the wearer's leg, also between the shin region and the calf region.

Orientation/directional terms are used herein, such as medial and lateral. It is contemplated that reciprocal terms may be substituted for one another herein. For example, when discussing a medial side and a lateral side, it is contemplated that the lateral side may be substituted with the medial side and vice versa. As a shin guard sleeve, such as the shin guard sleeve 100, may be formed particularly for a right leg or a left leg, substitution of the reciprocal terms allows for the contemplated mirror-image result.

Similarly, a shin guard sleeve, such as the shin guard sleeve 100, is contemplated to be used by an athlete by being worn in a traditional manner about the athlete's leg. The terminology "in an as-worn position" or the like is used herein to describe when the shin guard sleeve is worn in a proper orientation on an athlete. Aspects of the present invention contemplate utilizing a flexible material that achieves a desired effect when worn by a wearer. Consequently, while many features are inherent to the shin guard sleeve 100 when not in an as-worn position, at least some of those features may be more easily distinguished when in an as-worn position. Therefore, for clarity, the terminology of "in an as-worn position," may be included to help identify one or more features of a contemplated aspect of the present invention.

It is contemplated that the shin guard sleeve 100 may include a functional opening formed by the top edge 106. In particular, a traditional shin guard sleeve having a uniform opening at the upper portion of the shin guard may have a propensity to slip down the leg of the user. This may be cause by the movement of the wearer's leg creating an angular acceleration that pulls the shin guard sleeve away from a pivoting point (e.g., the knee or the hip). While a similar angular acceleration may be experienced by the shin guard sleeve 100, inclusion of a functional opening shape as described hereinafter alleviates some of the propensity of a shin guard sleeve to slip or slide down the leg of a wearer.

Figure 6:
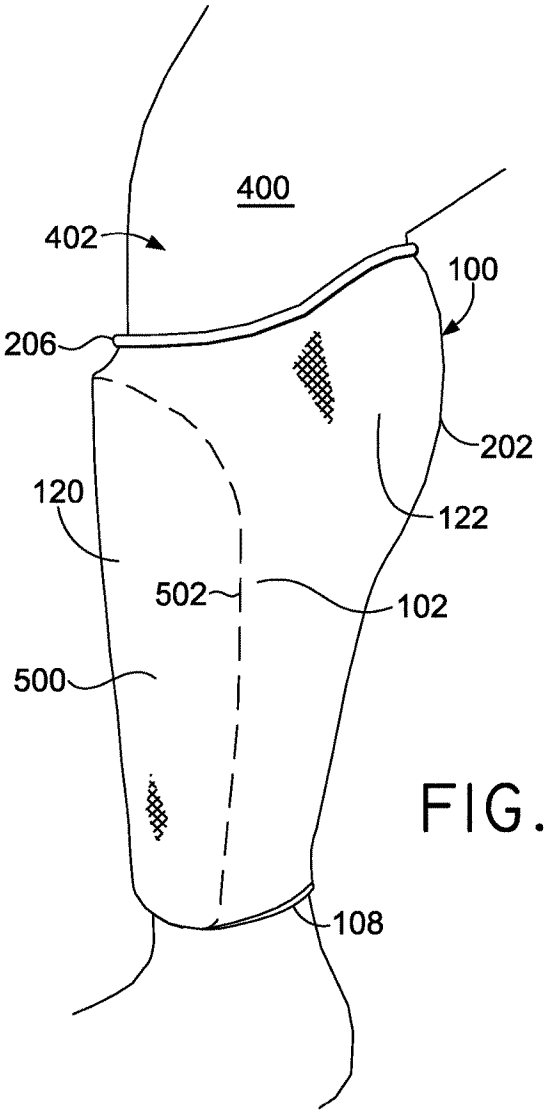
FIG. 6 depicts a medial view of a shin guard sleeve, in an as-worn position, in accordance with embodiments of the present invention.
Figure 7:
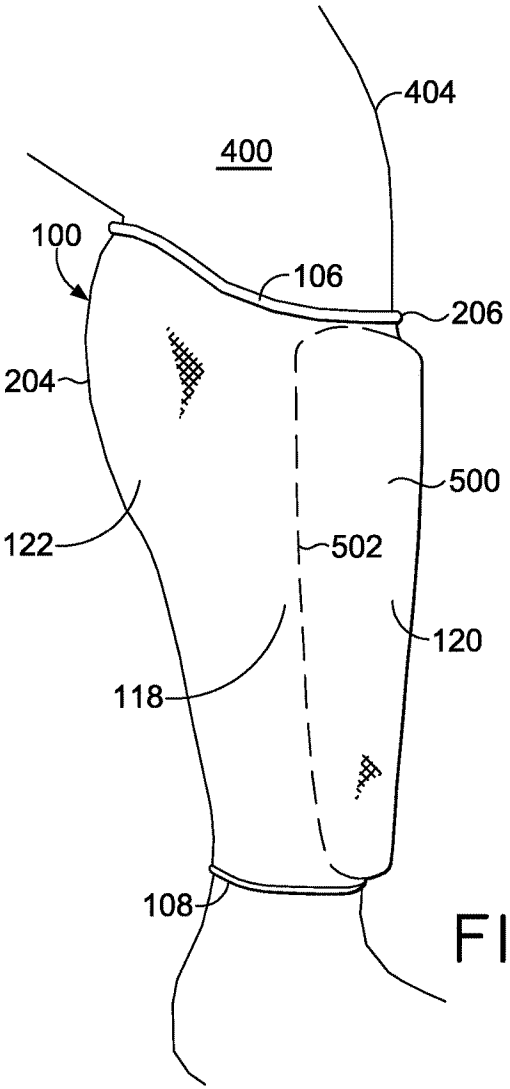
FIG. 7 depicts a lateral view of a shin guard sleeve, in an as-worn position, in accordance with embodiments of the present invention.

The functional opening of the shin guard sleeve 100 may be comprised of a lower point of contact in a shin region than in a calf region on a wearer (as seen in FIGS. 6 and 7). For example, the top edge 106 may "scoop" down at an anterior location of a wearer's leg while "scooping" up in a posterior location of the wearer's leg. Consequently, it is contemplated that the top edge 106 of the shin guard sleeve 100 may therefore rest above a thickest portion of the wearer's calf while being located at a lower point on the shin region. A functional opening of the shin guard sleeve 100 that rises above the thickest portion of the calf resists slipping in a distal (toward the foot) direction as the top edge 106 may be supported by, or otherwise rest above and therefore on, the calf muscle of the wearer.

As seen in FIG. 1, the top edge 106 extends in an upward direct from a depression 206. The depression 206 may be located in a shin portion of the shin guard sleeve 100. The depression 206, in an aspect, is the shortest distance between the bottom edge 108 and the top edge 106. The "height" of the depression 206 is identified by a dashed plane 214 in FIG. 1. The top edge 106 extends upwardly as it extends away from the depression 206. For example, in the aspect depicted in FIG. 1, where the top edge 106 joins with either the lateral edge 104 or the medial edge 102, the "height" is identified by a second dashed plane 212.

Figure 4:
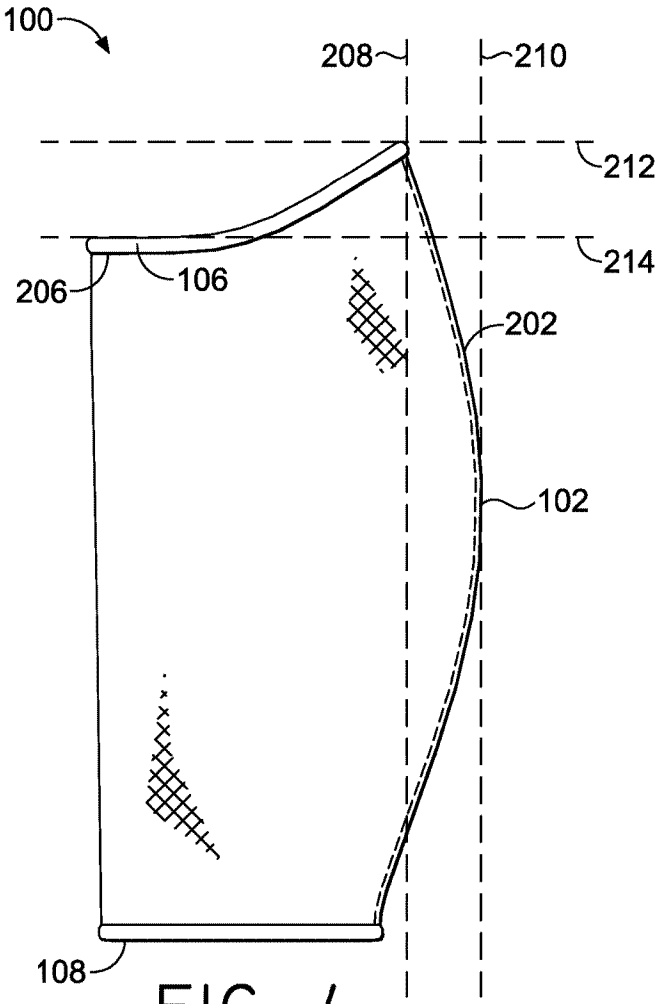
FIG. 4 depicts a medial view of a shin guard sleeve, in accordance with embodiments of the present invention.

When in an as-worn position, the depression 206 is proximate a shin region of the wearer and the medial edge 102 and the lateral edge 104 may be joined as a joining seam 306. The joining seam 306 may be proximate a calf region of a wearer, when in an as-worn position. In this exemplary as-worn position, the shin portion of the shin guard sleeve 100 may extend to the plane 214 while the calf portion of the shin guard sleeve 100 extends to the plane 212, which is "higher" when in an as-worn position (this is exemplified in FIG. 4).

Further, it is understood that the top depression 206 may provide an additional functional advantage in minimizing interaction between the shin guard sleeve 100 and a knee of the wearer. Consequently, the shin guard sleeve 100 may cover a larger portion of a wearer's calf without interfering with the flexibility or functionality of the knee. This too is an aspect that may not be accomplished by a uniform upper opening found in a traditional shin guard sleeve. For example, in a traditional shin guard sleeve having a "straight" (non-scooping) upper opening, in order to achieve the same amount of coverage of a calf region, a shin region of the shin guard sleeve may also have to extend an equal height up the leg of a wearer. To avoid interaction with a knee, a traditional shin guard sleeve that is desired to cover a large portion of the calf region may compress (e.g., bunch up) a shin portion. This compression may generate a downward force that compounds existing slipping issues.

The medial edge 102 and the lateral edge 104 may also be formed to provide additional contouring functionality. For example, it is contemplated that the shin guard sleeve 100, in an un-stretched state, includes a medial apex 202 and a lateral apex 204. For example, as illustrated in FIG. 1, the medial edge 102 extends away from a plane 208 extending from the intersection of the top edge 106 and the medial edge 102. The extent to which the medial apex 202 extends is illustrated by a plane 210, which for this illustration is parallel to the plane 208.

Stated differently, the medial apex 202 is located between the top edge 106 and the bottom edge 108 such that the medial apex is a point along an outwardly curving medial edge 102. When the medial edge 102 is joined with the lateral edge 104, the medial apex 202 in combination with the lateral apex 204 generate a volume of space able to be filled by a calf region of a wearer. In an aspect, when the medial edge 102 and the lateral edge 104 are joined to form the joining seam 306, the medial apex 202 coincides with the lateral apex 204 allowing the joining seam 306 to conform, in an un-stretch state, to a calf of a wearer.

As previously discussed, the shin guard sleeve 100 may be constructed from a stretchable material. A stretchable material may conform to and therefore better fit a leg of a wearer. However, by constructing the shin guard sleeve 100 to include a volume specifically shaped to be filled by a calf muscle, a more uniform tension may be applied across the entirety of the shin guard sleeve 100 as opposed to an increased level of tension at areas of greatest stretch for a traditional tubular-type sleeve. Therefore, when in an un-stretched state, the shin guard sleeve 100 is already in a contoured shape for receiving a leg portion of a wearer.

The planes 208, 210, 212, and 214 are provided merely for reference and ease of understanding. Each of these planes may also provide additional context herein. For example, the plane 208 may be used to describe a width of the top edge 106; the plane 210 may be used to describe an apex width; the plane 212 may be used to describe a posterior height; and the plane 214 may be used to describe an anterior height of the shin guard sleeve 100.

Figure 9:
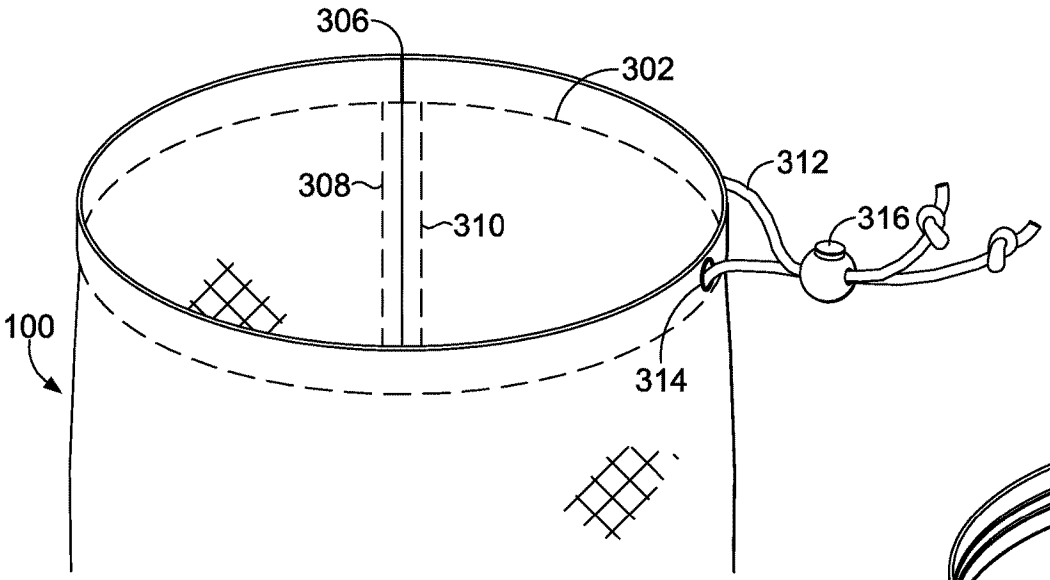
FIG. 9 depicts a fastener near a top edge of a shin guard sleeve, in accordance with embodiments of the present invention.
Figure 10:
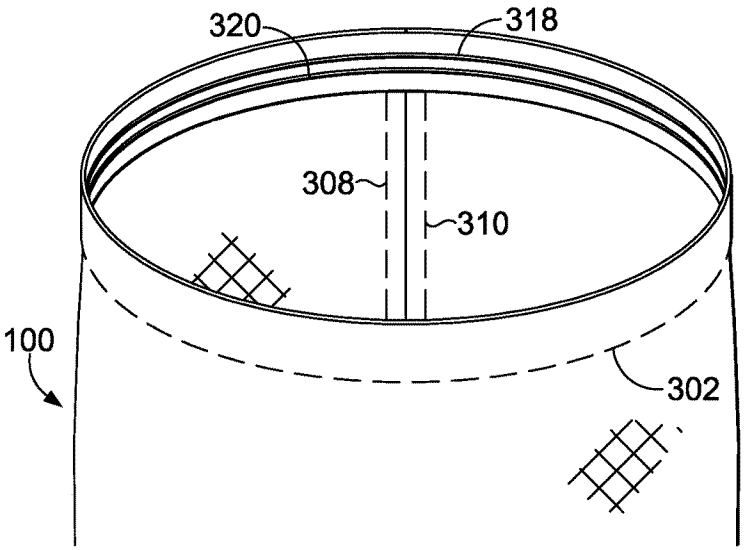
FIG. 10 depicts two maintainers near a top edge of a shin guard sleeve, in accordance with embodiments of the present invention.

The shin guard sleeve 100 may include, in aspects, a top seam 302. The top seam 302, may allow for one or more maintainers, as depicted in FIGS. 9 and 10. For example, the shin guard sleeve 100 may include a first maintainer 318 and/or a second maintainer 320 (as best seen in FIG. 10). In an example, the first maintainer 318 and the second maintainer 320 are a maintaining material. A maintaining material may include a material having a coefficient of friction relative to a wearer's body (or other articles of clothing/equipment) that is greater than that of the material from which the shin guard sleeve 100 is constructed. For example, it is contemplate that a maintaining material may include a rubberized material that is used as a stitching material. Continuing with this example, it is contemplated that the first maintainer 318 and the second maintainer 320 are stitching that extends around, at least a segment of the shin guard sleeve 100. In an exemplary aspect, the stitching extends from the medial edge 102 to the lateral edge 104 across the shin portion (i.e., across the entire shin guard sleeve 100).

In an additional example, a maintaining member may be a fastener, such as a fastener 312 depicted in FIG. 9. The fastener 312 may be a cord-like material that extends around the shin guard sleeve 100 to allow for a tension of the shin guard sleeve 100 proximate the fastener 312 to be adjusted. To accomplish this, the fastener 312 may extend though one or more fastener openings 314. While the fastener opening 314 is illustrated along a lateral portion of the shin guard sleeve 100, it is contemplated that the fastener opening 314 may be located along any portion of the shin guard sleeve 100 (e.g., proximate the calf portion). The fastener 312 may extend though a channel, a fastener channel, created by the top seam 302, which aids in maintaining the fastener 312 in a desired position relative to the shin guard sleeve 100. Adjustment of tension provided by the fastener 312 may be accomplished by a fastener retainer 316, as is well known in the art. Additionally, it is contemplated that the fastener 312 is a length of material affixed at each end to the shin guard sleeve 100 or onto itself to provide a tension force. For example, the fastener 312 may be constructed from a stretchable (e.g., elastic) material.

A maintainer assists in maintaining the shin guard sleeve 100 in a desired position when in an as-worn orientation. For example, the maintainer may provide a greater degree of slip resistance to the shin guard sleeve 100. Because the shin guard sleeve 100 may be constructed of a flexible material that has limited compression resistant in a longitudinal direction (e.g. up and down direction), it may be desired to locate a maintainer proximate the top edge 106 to take advantage of tensile strength provided by the material. Stated differently, a maintainer may be placed near the top of the shin guard sleeve 100 to resist a downward slip of the shin guard sleeve 100. An additional aspect may include a maintainer position in a longitudinal orientation. For example, one or more maintainer may be utilized along or near the joining seam 306. Locating a maintainer in a longitudinal direction may resist a downward slip as well as a lateral rotational slip.

A maintainer, in addition to be a stitching material or an integrated tensioning device, may also be an additional material that is coupled to the shin guard sleeve 100. For example, one or more portions of a maintaining member may be affixed (e.g., adhered, stitched, welded, and the like) to portions of the shin guard sleeve 100. Continuing with this example, the maintaining member may be a portion of sticky-type material that provides a higher coefficient of friction and/or a tensioning property that is affixed along a portion of the interior surface of the shin guard sleeve 100. The sticky-type material may include threading, banding, strips, and the like.

The shin guard sleeve 100 may also have a bottom seam 304 (as seen in FIG. 2). The bottom seam 304 may also provide a maintainer, as similarly discussed with respect to the top seam 302. For example, a tensioning material or a maintaining material having a higher coefficient of friction may be coupled with or affixed to the bottom seam 304 to aid in maintaining the shin guard sleeve 100 in a desired location when worn.

FIG. 2 depicts an anterior (e.g., front) view of the shin guard sleeve 100, in accordance with aspects of the present invention. The shin guard sleeve 100 may, in aspects, form a cylindrical shape by having the lateral edge 104 and the medial edge 102 joined to form the joining seam 306. When in a cylindrical shape, an outer surface 112 and an inner surface 114 are intuitive to discuss. However, it is understood that when the shin guard sleeve 100 is not formed as a cylindrical shape, the use of the terms inner and outer may be merely relative to a potential orientation when in an as-worn position. The anterior view of FIG. 2 also depicts the shin portion 120 centered between the medial portion 116 and the lateral portion 118. A resulting height increase of the top edge 106 as it extends from the shin portion 120 to the joining seam 306, which in this example is within a calf portion of the shin guard sleeve 100, is also depicted in FIG. 2.

Figure 3:
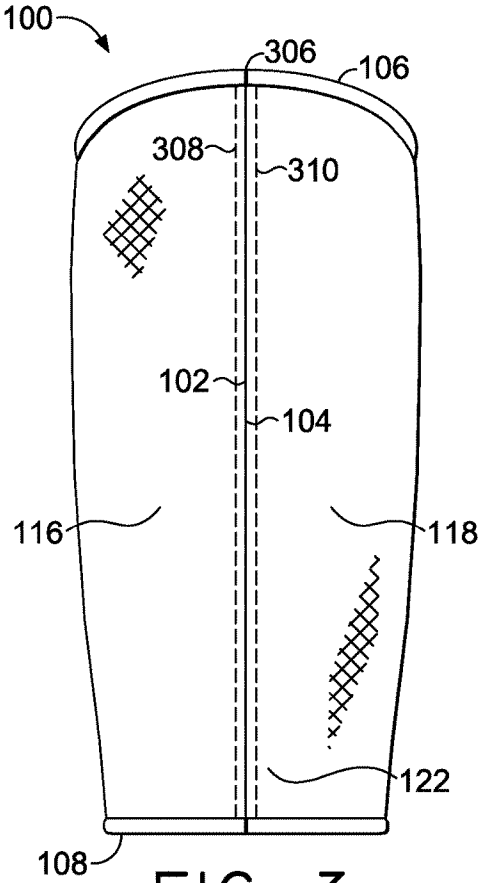
FIG. 3 depicts a posterior view of a shin guard sleeve, in accordance with embodiments of the present invention.

FIG. 3 depicts a posterior (e.g., rear) view of the shin guard sleeve 100, in accordance with aspects of the present invention. The posterior view offers a view of the calf portion 122 between the medial portion 116 and the lateral portion 118. The joining seam 306 extends from the top edge 106 down to the bottom edge 108. In the aspect depicted in FIG. 3, a medial stitching 308 and a lateral stitching 310 are disposed along the joining seam 306. In an exemplary aspect, the medial stitching 308 and the lateral stitching 310 include (or themselves are) a maintainer. For example, the material used for the stitching (e.g., thread) may be a material having a higher coefficient of friction relative to the wearer than the surrounding materials. In an additional exemplary aspect, it is contemplated that the medial stitching 308 and/or the lateral stitching 310 are used, at least in part, to form the joining seam 306, which may join the lateral edge 104 to the medial edge 102.

FIG. 3 depicts a medial view of the shin guard sleeve 100, in accordance with aspects of the present invention. In particular, a height different between an anterior height, as depicted by the plane 214, and the posterior height, as depicted by the plane 212 is illustrated. Additionally, a difference between a front edge width, as depicted by the plane 208, and an apex width, as depicted by the plane 212, is illustrated. It is understood that the height difference and the width difference, as illustrated herein, are exemplary in nature and not limiting to the present invention. For example, it is contemplate that a greater or a lesser height difference may be implemented in aspects of the present invention. Similarly, it is contemplated that greater or lesser width differences may be implemented in aspects of the present invention. Further, it is contemplated that no height difference or width difference may be implemented in aspects of the present invention.

Figure 5:
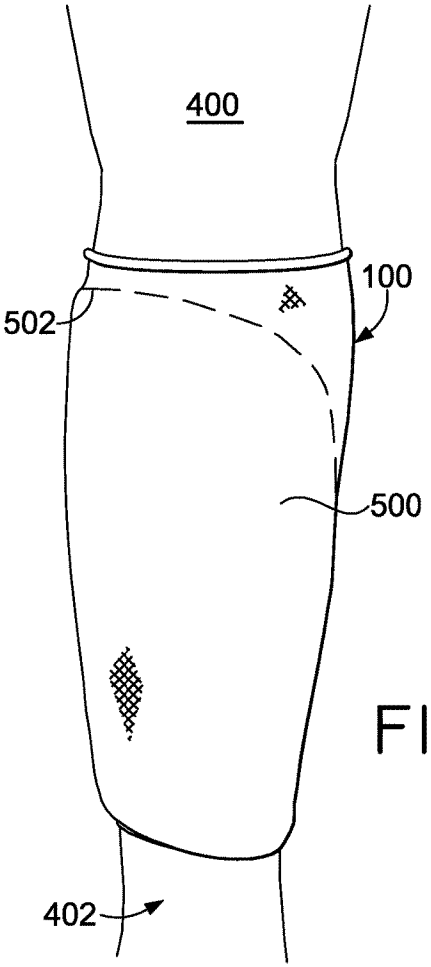
FIG. 5 depicts a shin view of a shin guard sleeve, in an as-worn position, in accordance with embodiments of the present invention.

FIG. 5 depicts a shin (e.g., anterior) view of the shin guard sleeve 100 in an as-worn position, in accordance with aspects of the present invention. The shin guard sleeve 100 has received a leg 400 proximate a shin region 402. The shin guard sleeve 100 may include a pad pocket 502 for maintain a pad 500 in a desired location. For example, it is contemplated that the pad 500 may be a rigid or semi-rigid material for absorbing an impact force, as is known in the art. The pocket 502 may allow for the pad 500 to be permanently maintained within the pocket 502. Additionally, it is contemplated that the pocket 502 allows for the pad 500 to be removeably maintained, which would allow for the pad 500 to be removed or otherwise adjusted.

FIG. 6 depicts a medial view of the shin guard sleeve 100 when in an as-worn position, in accordance with aspects of the present invention. The medial view of FIG. 6 depicts the height difference as the top edge extends from the shin portion 120 toward the calf portion 122. Additionally, FIG. 6 depicts the apex 202, as filled by a calf region of a wearer.

FIG. 7 depicts a lateral view of the shin guard sleeve 100 when in an as-worn position, in accordance with aspects of the present invention. Similar to FIG. 6, the shin guard sleeve 100 is disposed on the leg 400 below a knee 404. The pocket 502 is illustrated covering a shin region of the leg 400. It is understood that the pocket 502 may be disposed at an interior portion of the shin guard sleeve 100, an exterior portion of the shin guard sleeve 100, or omitted altogether.

Figure 8:
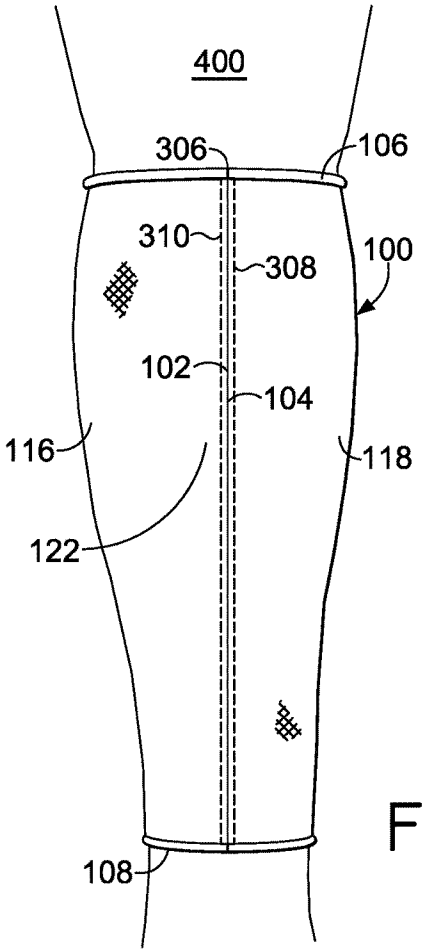
FIG. 8 depicts a calf view of a shin guard sleeve, in an as-worn position, in accordance with embodiments of the present invention.

FIG. 8 depicts a calf (e.g., posterior) view of the shin guard sleeve 100 when in an as-worn position, in accordance with aspects of the present invention.

The term "proximate" has been used herein to describe a locational relationship of objects, features, and/or portions. It is understood that proximate may represent a locational proximity of within 6 inches, within 1 inch, within 1 centimeter, within 1 millimeter, and/or nearly corresponding. This interpretation of proximate is appropriate for a shin guard sleeve constructed from a flexible material, which may have elastic (e.g., ability to stretch) characteristics.

Additionally, terms related to a wearer's anatomy have been used herein. For example, the "calf region" of a wearer includes an area of the wearer's leg that is traditionally associated with a calf muscle. Similarly, a "shin region" of a wearer includes an area of the wearer's leg that is traditionally associated with an anterior portion of a tibia bone of the wearer, as is customary.

Although the shin guard sleeve is described above by referring to particular aspects, it should be understood that modification and variations could be made to the shin guard construction described without departing from the intended scope of protection provided by the following claims.

The invention claimed is:

1. A shin guard sleeve constructed from a flexible material, in an un-stretched state, comprising:

a shin portion and an opposite calf portion, wherein the shin portion is proximate a shin region of a wearer's leg and the calf portion is proximate a calf region of the leg when the shin guard sleeve is in an as-worn position;

a medial portion and an opposite lateral portion, wherein when in an as-worn position, the medial portion is disposed between the calf portion and the shin portion, and the lateral portion is disposed between the calf portion and the shin portion;

a top edge and an opposite bottom edge; wherein the medial portion, the shin portion, the lateral portion, and the calf portion are disposed between the top edge and the bottom edge;

a medial edge and an opposite lateral edge; wherein when in an as-worn position, the medial edge and the opposite lateral edge join to form a joining seam extending from the top edge to the bottom edge proximate the calf region;

an intermediate portion between the top edge and the bottom edge that extends from the medial edge to the lateral edge proximate a medial apex and a lateral apex;

a shin distance as measured from the top edge to the bottom edge proximate the shin portion that is less than a calf distance as measured from the top edge to the bottom edge proximate the calf portion;

a bottom edge length between the medial edge and the lateral edge proximate the bottom edge is less than an intermediate length between the medial edge and the lateral edge within the intermediate portion, wherein the bottom edge length and the intermediate length extend across the shin portion; and a maintainer coupled proximate the top edge, wherein the maintainer comprises a material having a coefficient of friction greater than a coefficient of friction of the flexible material.

2. The sleeve of claim 1, wherein the maintainer further comprises a first maintainer and a second maintainer.

3. The sleeve of claim 1, further comprising a bottom maintainer coupled proximate the bottom edge, wherein the bottom maintainer comprises the material having the coefficient of friction greater than the coefficient of friction of the flexible material.

4. The sleeve of claim 1, wherein the maintainer is a rubberized stitching material located at one or more seams of the sleeve, the rubberized stitching material having the coefficient of friction greater than the coefficient of friction of the flexible material.

5. The sleeve of claim 4, further comprising a longitudinal maintainer located at the joining seam.

6. The sleeve of claim 1, further comprising a maintaining member constructed from a sticky-type material affixed along a portion of an interior surface of the sleeve, the sticky-type material having the coefficient of friction greater than the coefficient of friction of the flexible material.

7. A shin-guard sleeve having an open-ended, generally tubular structure comprising:

a wall of flexible material having a top edge;

a bottom edge generally opposing the top edge;

a first side edge connecting the top edge to the bottom edge;

a second side edge generally opposing the first edge and connecting the top edge to the bottom edge, wherein the top edge includes a first portion positioned at a midpoint between the first side edge and the second side edge, the first portion being spaced apart from the bottom edge by a first length of flexible material, wherein the top edge includes a second portion positioned at a junction of the top edge and the first side edge, the second portion being spaced apart from the bottom edge by a second length of flexible material, and wherein the top edge includes a third portion positioned at a junction of the top edge and the second side edge, the third portion being spaced apart from the bottom edge by a third length of flexible material that is the same as the second length of flexible material and that is longer than the first length of flexible material; and a seam connecting the first side edge near the second side edge and the second portion of the top edge near the third portion of the top edge to form the open-ended generally tubular structure, the seam extending from the top edge to the bottom edge and including a seam length measured from the top edge to the bottom edge, wherein the seam length includes a dimension that is at least as long as the second and third length of flexible material and that is at least as long as any other length of flexible material connecting the top edge to the bottom edge.

8. A shin-guard sleeve having an open-ended, generally tubular structure comprising:

a wall of flexible material including a bound body portion that is bound by perimeter edges, including:

a top edge;

a bottom edge generally opposing the top edge;

a first side edge connected to the top edge at a first junction and connected to the bottom edge at a second junction, the first side edge including a first side apex that is positioned between the first junction and the second junction and that curves outward, away from the bound body portion of the wall of flexible material;

a second side edge generally opposing the first edge and connected to the top edge at a third junction and connected to the bottom edge at a fourth junction, the second side edge having a second side apex that is positioned between the third junction and the fourth junction and that curves outward, away from the bound body portion of the wall of flexible material, wherein the top edge includes a top-edge midpoint between the first side edge and the second side edge and the bottom edge includes a bottom-edge midpoint between the first side edge and the second side edge, a midline extending from the top-edge midpoint to the bottom edge midpoint and including a first length of flexible material, wherein the top edge includes a first side portion positioned at a junction of the top edge and the first side edge, the first side portion being spaced apart from the bottom edge by a second length of flexible material, wherein the top edge includes a second side portion positioned at a junction of the top edge and the second side edge, the second side portion being spaced apart from the bottom edge by a third length of flexible material that is a same length as the second length of flexible material and that is longer than the first length of flexible material; and a seam connecting the first side edge near the second side edge and the first side portion of the top edge near the second side portion of the top edge to form the open-ended generally tubular structure, wherein the seam extends from the top edge to the bottom edge and includes a seam length measured from the top edge to the bottom edge, wherein the seam length includes a dimension that is at least as long as the second and third lengths of flexible material and that is at least as long as any other length of flexible material connecting the top edge to the bottom edge, and wherein the seam connects the first side apex near the second side apex such that an amount of flexible material between the midline and the seam is greatest at the first side apex and the second side apex.

9. The shin-guard sleeve of claim 8, wherein the first side apex is spaced apart from the second side apex by a fourth length of flexible material, the fourth length of flexible material being the greatest distance between the first side edge and the second side edge.

10. The shin-guard sleeve of claim 9, wherein the wall of flexible material includes a consistent amount of tension across the entire wall of flexible material.

* * * * *